US005791300A

United States Patent [19]

Phelps, Sr.

[11] Patent Number: 5,791,300

[45] Date of Patent: Aug. 11, 1998

[54] STEAM GENERATOR PARALLEL BACK END USING PENDANT PRIMARY SUPERHEATER AND BAFFLE WALL WITH GAS-TIGHT HEADER VESTIBULE

[75] Inventor: Calvin Eugene Phelps, Sr., Akron, Ohio

[73] Assignee: The Babcock & Wilcox Company, New Orleans, La.

[21] Appl. No.: 600,618

[22] Filed: Feb. 13, 1996

[51] Int. Cl.[6] ..... F22B 25/00; F22G 3/00

[52] U.S. Cl. ..... 122/459; 122/235.11; 122/235.22

[58] Field of Search ..... 122/421, 451, 122/451.1, 459, 460, 6 A, 235.11, 235.12, 235.15, 235.22, 235.23, 235.24

[56] References Cited

U.S. PATENT DOCUMENTS 3,060,903 10/1962 Rudd ..... 122/235.11

3,818,873 6/1974 Watanabe et al. ..... 122/235

4,454,838 6/1984 Strohmeyer, Jr. ..... 122/4 D

*Primary Examiner*—Henry A. Bennett

*Assistant Examiner*—Gregory A. Wilson

*Attorney, Agent, or Firm*—R. J. Edwards; D. Neil LaHaye

[57] ABSTRACT

A steam generator parallel back end arrangement divides a flue gas flow into a plurality of paths in the steam generator housing. A pendant primary superheater is located in the housing near the top of the housing and a baffle wall having tubes therethrough vertically extends from the bottom of the housing in the flue gas flow. The baffle wall is divided into enclosure walls which extend upwardly in the housing and define an interior space therebetween. A top directional baffle is connected to the enclosure walls for forming a gas-tight vestibule in which an inlet header of a reheater and an outlet header of an economizer are supported and contained therein for protection from the flue gas environment.

6 Claims, 1 Drawing Sheet

STEAM GENERATOR PARALLEL BACK END USING PENDANT PRIMARY SUPERHEATER AND BAFFLE WALL WITH GAS-TIGHT HEADER VESTIBULE

FIELD AND BACKGROUND OF THE INVENTION

The present invention relates, in general, to steam generators and, in particular, to a new and useful arrangement for a steam generator utilizing a pendant primary superheater and baffle wall with gas-tight header vestibule.

In the power plant field, steam generators, including once-through, natural circulation, and assisted circulation types, now use parallel back ends to split a total gas flow into separate paths, in combination with setting the amount of convective type heating surfaces in each path and using path outlet dampers to control the amount of gas flow in each path, to effectively gain control of the hot reheat outlet steam temperature and to control it to a fixed, designed temperature over an operating load range of the unit. These designs are a means to improve the reheat turbine efficiency by controlling it with an almost constant, designed inlet steam temperature over its operating range; and, in some type of turbines that use a common high pressure-intermediate reheat pressure shell, to avoid exceeding a temperature differential limit between the main steam and the hot reheat steam temperatures because of design limitations within the turbine from resulting differential expansions.

Known designs utilize steam generator parallel back ends with horizontal heating surfaces, headers exposed in the gas streams, and economizer stringer tubes to support horizontal surfaces whose lengths exceed the limitations of the designs such that they cannot be wall supported. In the case of once-through steam generators, one or more economizer discharge downcomers are routed from the penthouse, after collecting the economizer stringer outlet flows, to the bottom of the furnace thereby increasing the lengths of these downcomers. The horizontal and pendant convection pass outlet headers are arranged inside the penthouse, making it necessary to collect these flows and route one or more downcomers down to the primary superheater or evaporator inlet headers, thus increasing the material requirements with the extra downcomers.

SUMMARY OF THE INVENTION

The present invention reduces the space required for the parallel back end in steam generators through the use of a new type of baffle wall and by arranging the primary superheater as a pendant surface. For the known steam generators, this area is a very large gas turning cavity with stringers passing through. The present invention, however, uses a baffle wall that is split so that a gas tight vestibule is formed to house the reheat inlet and economizer outlet headers, and an arch is used at the top of the vestibule to serve as a directional baffle for the pendant primary superheater. In addition, the new baffle wall vestibule also supports the enclosed headers since it will be operating internally at its fluid temperature and many type mechanical supports can be used without exceeding their material temperature limitations. The vestibule adds flexibility to the back end arrangement by its shape and the additional variation allowed in manipulation of its dimensions allows the horizontal surfaces to be wall supported to eliminate stringer tube supports. For a once-through steam generator, the economizer discharge downcomers are routed from the vestibule elevation in lieu of the penthouse, and the present invention eliminates the primary superheater downcomers. This new arrangement allows the depth of the horizontal convection pass to be reduced. On some applications, the height of the convection pass may also be reduced.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
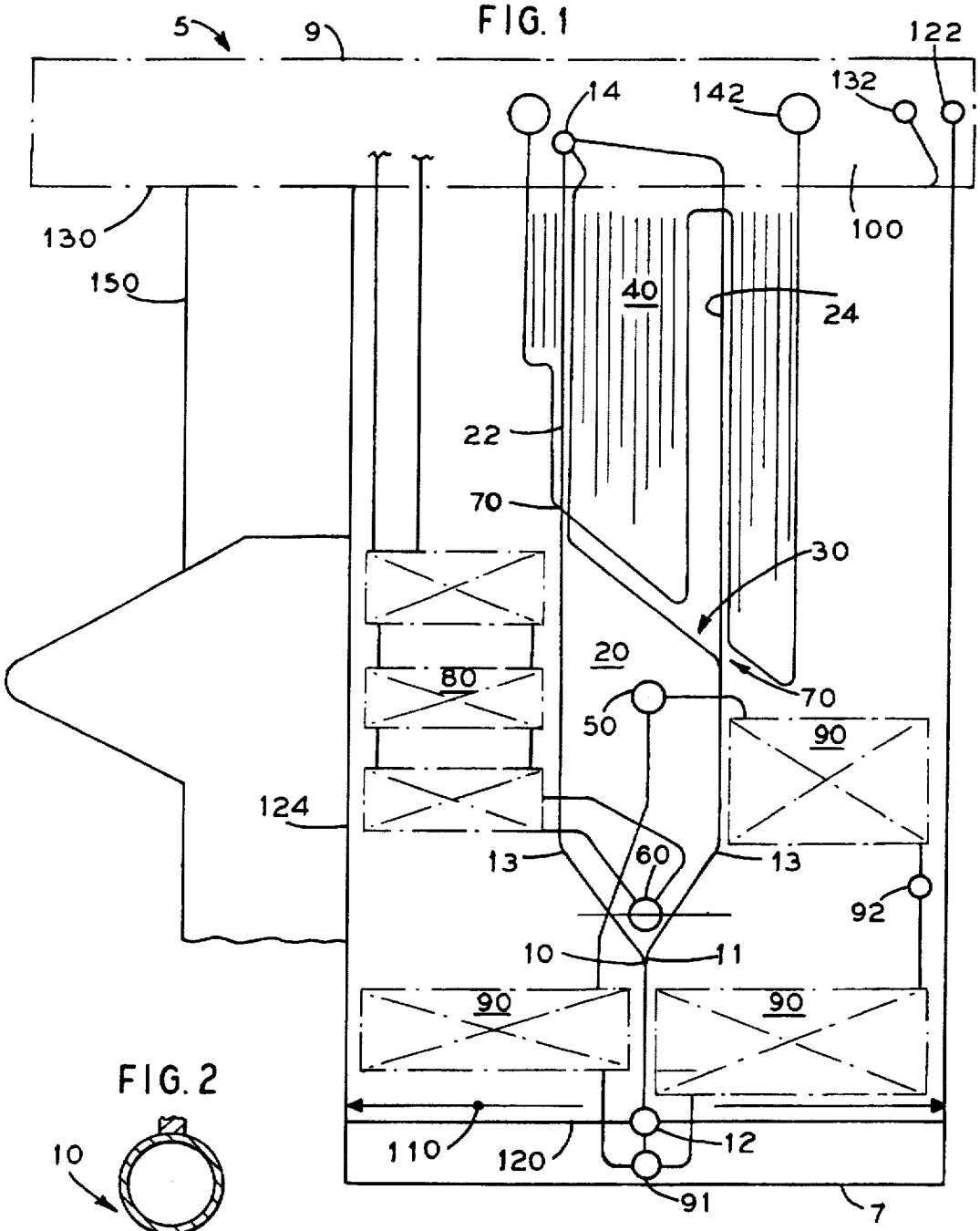
FIG. 1 is a schematic view illustrating a steam generator parallel back end arrangement according to the present invention.

Referring to the drawings, the present invention incorporated therein, as best illustrated in FIG. 1, comprises the back end of a steam generator, generally designated 5, having a lower end 7 and an upper end 9 defining a boundary. A baffle wall 10 extends from the lower inlet header 12 vertically within the housing 5 for establishing a parallel back end which divides the flue gas stream.

Figure 2:
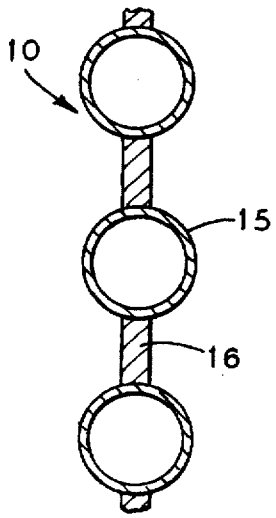
FIG. 2 is a top sectional view of a baffle wall of FIG. 1.

As shown in FIG. 2, the baffle wall 10 is a tube membrane wall comprising fluid conveying tubes 15 and metallic webs 16 which close the intertube spaces and are normally seal-welded to the adjoining tube 15. The vertically oriented tubes 15 in baffle wall 10 are reoriented as indicated at 11 with each alternate tube 15 extending along opposite upwardly inclined and vertical planes to form a gas-tight vestibule 20. The webs 16 which interconnect tubes 15 surrounding the vestibule 20 are sized to accommodate the wider intertube spacing. The tubes 15 which extend above the vestibule 20 are not interconnected by webs so as to form screens at 22 and 24, permitting the flow of heating gases therebetween.

A fluid split indicated at reference numeral 11 is a division of the baffle wall 10 into enclosure walls 13 which forms a gas-tight vestibule 20. Tubes 15 are arranged in enclosure walls 13 for carrying fluid therein. An arch or directional baffle 30 serves as the top of the vestibule 20 for directing the gas flow to a pendant primary superheater 40 which is located directly above the gas-tight vestibule 20 as shown in FIG. 1. The baffle wall 10 has a baffle wall inlet header 12 near the bottom 7 of the steam generator back end 5 and an outlet header 14 located near the top 9 of the steam generator 5 as shown in FIG. 1. The gas-tight baffle wall vestibule 20 isolates an outlet header 50 of an economizer 90 and isolates an inlet header 60 for reheater 80 as illustrated in FIG. 1. The gas-tight vestibule 20 also provides a means to support the headers 50 and 60.

The vestibule outlet tubes 70 are arranged as screen tubes (without metallic webs between tubes)at the same side-to-side dimensions as the primary superheater 40. The vestibule outlet tubes 70, which are a continuation of the tubes in enclosure walls 13, have the directional baffle 30 attached between the two groups of tubes. This provides support to the vestibule 20 by transmitting loads to the boiler top support steel.

The shape of the vestibule 20 allows the horizontal reheat surface 80, the economizer surface 90, or evaporator surface if required, to be wall supported without requiring economizer outlet stringer supports to the penthouse 100. Thus, the economizer discharge downcomers from outlet header 50 to the bottom of the furnace are considerably shortened since they do not start at the elevation of the penthouse 100, but rather, start at the elevation of the vestibule 20. The horizontal convection pass path depth 110 is also shortened in the embodiment shown.

In some cases, the height from the horizontal convection pass inlet headers,schematically indicated by numeral 120, to the centerline of the furnace roof 130 are shortened. Primary superheater steam supply downcomers are eliminated with the present invention since inlet header 142 for this heating surface is relocated inside of the penthouse 100.

Economizer 90 has economizer outlet header 50 supported and sealed within the gas-tight vestibule 20 as shown. The economizer inlet header 91 and transitional header 92 may be relocated inside the vestibule 20 if desired.

While the horizontal convection pass inlet headers 120 are located near the bottom 7 of the unit 5, the horizontal convection pass rear wall outlet headers 122 are located adjacent roof outlet header 132. These headers and all other headers may remain in their current locations. Horizontal convection pass front wall 124 extends from the bottom 7 to the roof 130 and is parallel with rear screen tubes and front screen tubes 150.

The present invention substantially reduces financial costs involved with steam generators and provides flexibility due to the novel arrangement for parallel back end heating surfaces. The gas type vestibule 20 is a great advantage over the known systems since it provides a means to mechanically support the economizer outlet header 50 and the reheater inlet header 60 as well as protect the header 50 and 60 from the flue gas environment.

Another advantage provided by the present invention is that flue gas flow is channeled directly to the pendant primary superheater 40 by the directional baffle 30 which is an arch and is the top of the vestibule 20. Moreover, the present invention provides a parallel back end steam generator 5 that eliminates the large gas turning cavity with stringers therethrough common to the known systems.

While specific embodiments of the invention have been shown and described in detail to illustrate the application of the principles of the invention, it will be understood that the invention may be embodied otherwise without departing from such principles.

What is claimed is:

1. An arrangement for dividing a flue gas flow into a plurality of paths in a steam generator comprising:

a housing having a top and a bottom;

a pendant primary superheater in the housing located near the top of the housing;

a baffle wall comprising tube means and extending in the flue gas flow within the housing near the bottom of the housing, the baffle wall being divided into enclosure walls extending upwardly in the housing;

an arched top baffle section connected to the enclosure walls for directing the flue gas flow to the primary superheater, the enclosure walls and the top baffle section defining an interior space therebetween, and forming a gas-tight vestibule, the gas-tight vestibule being located below the primary superheater in the housing;

means for channeling a fluid through the tube means;

an economizer in the housing in the flue gas flow and having an outlet header supported within the gas-tight vestibule; and a reheater in the housing in the flue gas flow and having an inlet header supported within the gas-tight vestibule.

2. The arrangement according to claim 1, wherein the means for channeling fluid comprises a baffle wall inlet header and a baffle wall outlet header.

3. The arrangement according to claim 2, including a plurality of outlet tubes connected to the gas-tight vestibule and the baffle wall outlet header.

4. The arrangement according to claim 3, wherein the baffle wall inlet header is located near the bottom of the housing.

5. The arrangement according to claim 4, wherein the baffle wall outlet header is located near the top of the housing.

6. The arrangement according to claim 5, wherein the outlet tubes extend vertically in the housing between the gas-tight vestibule and the baffle wall outlet header.

* * * * *